US009779719B2

(12) United States Patent
Judd

(10) Patent No.: US 9,779,719 B2
(45) Date of Patent: Oct. 3, 2017

(54) ANC CONVERGENCE FACTOR ESTIMATION AS A FUNCTION OF FREQUENCY

(71) Applicant: Panasonic Automotive Systems Company of America, Division of Panasonic Corporation of North America, Peachtree City, GA (US)

(72) Inventor: Darrel Ray Judd, Pleasant Grove, UT (US)

(73) Assignee: Panasonic Automotive Systems Company of America, Division of Panasonic Corporation of North America, Peachtree City, GA (US)

( * ) Notice: Subject to any disclaimer, the term of this patent is extended or adjusted under 35 U.S.C. 154(b) by 0 days.

(21) Appl. No.: 15/365,994

(22) Filed: Dec. 1, 2016

(65) Prior Publication Data

US 2017/0162185 A1 Jun. 8, 2017

Related U.S. Application Data

(60) Provisional application No. 62/262,678, filed on Dec. 3, 2015.

(51) Int. Cl.
*G10K 11/178* (2006.01)

(52) U.S. Cl.
CPC .. *G10K 11/1786* (2013.01); *G10K 2210/1282* (2013.01); *G10K 2210/3018* (2013.01);
(Continued)

(58) Field of Classification Search
CPC ... G10K 2210/3055; G10K 2210/1282; G10K 2210/3014; G10K 2210/504;
(Continued)

(56) References Cited

U.S. PATENT DOCUMENTS 5,321,759 A * 6/1994 Yuan ..... F01N 1/065 381/71.12
5,359,662 A * 10/1994 Yuan ..... G10K 11/1786 381/71.12

(Continued)

OTHER PUBLICATIONS

Kuo, S. M., Active Noise Control Algorithms and DSP Implementations, 1996, John Wiley & Sons, Inc., New York City.

*Primary Examiner* — Mohammad Islam
(74) *Attorney, Agent, or Firm* — Laurence S. Roach, Esq.

(57) ABSTRACT

A method of operating an audio system in a vehicle includes providing m number of microphones disposed within a passenger compartment of the vehicle. The microphones produce a plurality of microphone signals. Within the passenger compartment of the vehicle, k number of loudspeakers are provided. A plurality of convergence factors μ for use in performing active noise control are estimated. The estimating includes calculating an Eigen value λ(ω) of an autocorrelation matrix of a passenger compartment transfer function as $$\lambda_k(\omega) = \frac{A_k(\omega)^2}{2},$$

wherein $A_k(\omega)$ is the frequency response of the passenger compartment transfer function. A frequency $\omega_{min}$ of a local minimum of λ(ω) is determined. A largest stable value for $\mu Max(\omega_{min})$ is found by experimentation, wherein a rotational speed of an engine of the vehicle, expressed in revolutions per minute, $f_{rpm}=2\pi\omega_{min}$. A calibration factor is calculated as $L=\lambda(\omega_{min})\mu Max(\omega_{min})$. All values of μMax(ω) are estimated as (Continued)

$$\mu\mathrm{Max}(\omega) = \frac{L}{\lambda(\omega)}.$$

A plurality of active noise controlled audio signals are transmitted to the loudspeaker. The active noise controlled audio signals are dependent upon the microphone signals and the estimated convergence factors.

20 Claims, 7 Drawing Sheets

(52) U.S. Cl.
CPC ..... *G10K 2210/3021* (2013.01); *G10K 2210/3028* (2013.01); *G10K 2210/3055* (2013.01)

(58) Field of Classification Search
CPC ..... G10K 2210/1082; G10K 2210/129; G10K 2210/30231; G10K 2210/12; G10K 2210/128; G10K 2210/1281; G10K 2210/1283; G10K 2210/3023
See application file for complete search history.

(56) References Cited

U.S. PATENT DOCUMENTS

| | | | | |
|---|---|---|---|---|
| 8,848,937 | B2 * | 9/2014 | Inoue | G10K 11/16 381/71.1 |
| 2008/0144853 | A1 * | 6/2008 | Sommerfeldt | G10K 11/1788 381/71.11 |
| 2013/0259253 | A1 * | 10/2013 | Alves | G10K 11/1784 381/71.12 |
| 2016/0298316 | A1 * | 10/2016 | Iwamura | E02F 9/2004 |

* cited by examiner

Notes

- The following convention is used to describe the dimensions of the ANC MxK
- K = number of speakers
- M = number of microphones
- While a 2x3 system is shown, the ANC system can be generalized to any practical number of speakers and microphones.

ANC CONVERGENCE FACTOR ESTIMATION AS A FUNCTION OF FREQUENCY

CROSS-REFERENCED TO RELATED APPLICATIONS

This application claims benefit of U.S. Provisional Application No. 62/262,678 filed on Dec. 3, 2015, which the disclosure of which is hereby incorporated by reference in its entirety for all purposes.

FIELD OF THE INVENTION

The disclosure relates to the field of active noise control (ANC) in audio systems, and, more particularly, to ANC in audio systems in motor vehicles.

BACKGROUND OF THE INVENTION

Currently, convergence factors for ANC are determined by experimentation. ANC systems are based on adaptive filter technology. The adaptive filter algorithm normally used for ANC is gradient search Least Mean Squared (LMS). A key point to the stability of an LMS system is the choice of the convergence factor (or step size μ). For an automotive application, the engine hum or boom is cancelled with an ANC system. Since the engine boom changes frequency as the engine Revolutions per Minute (RPM) changes, a unique convergence factor must be considered for each discrete frequency allowed in the ANC system. For an ANC system with M microphones and K speakers, the number of unique frequency responses required is M*K. If the ANC system has an operating frequency range of 20-250 Hz, there are 230 unique frequencies with a frequency resolution of 1 Hz. This could require 230*K unique convergence factors. These convergence factors are currently determined by experimentation. The task of creating tables of convergence factors for an ANC Systems becomes very costly and time consuming.

While many advances have been made to improve automotive ANC algorithms, each method has its own set of problems. Each method has to be custom tuned for each targeted enclosure. A large part of this tuning is coming up with stable values for μ. If there were only one value this would not be an issue. Given the specifications for a typical ANC system:

two microphones
three speakers
Frequency range of 20-250 Hz
Frequency resolution of 1 Hz.

There would need to be 230*3=690 values for μ. If the average time to calibrate/re-calibrate each value of μ is twenty minutes with two technicians, then the total man-hours required for tuning would be 460 hours. Many of these hours are spent in a car on a dynamometer rack, and there are additional costs associated with using a dynamometer.

SUMMARY

The present invention may provide a method to calculate convergence factors as a function of frequency for Active Noise Control (ANC). The invention may also provide a new and innovative method for calculating stable values for these convergence factors in a timely manner.

In one embodiment, the invention comprises a method of operating an audio system in a vehicle, including providing m number of microphones disposed within a passenger compartment of the vehicle. The microphones produce a plurality of microphone signals. Within the passenger compartment of the vehicle, k number of loudspeakers are provided. A plurality of convergence factors μ for use in performing active noise control are estimated. The estimating includes calculating an Eigen value λ(ω) of an autocorrelation matrix of a passenger compartment transfer function as $$\lambda_k(\omega) = \frac{A_k(\omega)^2}{2},$$

wherein $A_k(\omega)$ is the frequency response of the passenger compartment transfer function. A frequency $\omega_{min}$ of a local minimum of λ(ω) is determined. A largest stable value for $\mu\mathrm{Max}(\omega_{min})$ is found by experimentation, wherein a rotational speed of an engine of the vehicle, expressed in revolutions per minute, $f_{rpm}=2\pi\omega_{min}$. A calibration factor is calculated as $L=\lambda(\omega_{min})\mu\mathrm{Max}(\omega_{min})$. All values of μMax(ω) are estimated as $$\mu\mathrm{Max}(\omega) = \frac{L}{\lambda(\omega)}.$$

A plurality of active noise controlled audio signals are transmitted to the loudspeaker. The active noise controlled audio signals are dependent upon the microphone signals and the estimated convergence factors.

In another embodiment, the invention comprises a method of operating an audio system in a vehicle, including providing a plurality of microphones in association with a passenger compartment of the vehicle. The microphones produce a plurality of microphone signals. A plurality of loudspeakers are provided in association with the passenger compartment of the vehicle. A plurality of convergence factors are estimated for use in performing active noise control. The estimating includes calculating an Eigen value of an autocorrelation matrix of a passenger compartment transfer function. The Eigen value is a function of a rotational speed of an engine of the vehicle. An engine rotational speed associated with a local minimum of the Eigen value is determined. A largest stable value for one of the convergence factors at a minimum engine speed is found by experimentation. A calibration factor is calculated dependent upon the largest stable value for one of the convergence factors at a minimum engine speed. All values of the convergence factor within a range of engine speeds are estimated. The estimating is dependent upon the calibration factor and the Eigen values within the range of engine speeds. A plurality of active noise controlled audio signals are transmitted to the loudspeaker. The active noise controlled audio signals are dependent upon the microphone signals and the estimated convergence factor values.

In yet another embodiment, the invention comprises a method of operating an audio system in a vehicle, including providing at least one microphone associated with a passenger compartment of the vehicle. The microphone produces a plurality of microphone signals. At least one loudspeaker associated with the passenger compartment of the vehicle is provided. A plurality of convergence factors for use in performing active noise control are estimated. The estimating includes calculating an Eigen value of an autocorrelation matrix of a passenger compartment transfer function. A calibration factor is calculated dependent upon a largest stable value for one of the convergence factors at a minimum engine speed. All values of the one convergence factor within a range of engine speeds are estimated. The estimating is dependent upon the calibration factor and a plurality of Eigen values within the range of engine speeds. A plurality of active noise controlled audio signals are transmitted to the loudspeaker. The active noise controlled audio signals are dependent upon the microphone signals and the estimated convergence factor values.

An advantage of the present invention is that it may decrease tuning time for ANC systems.

Another advantage of the present invention is that it may be used for hardware or software embodiments of ANC.

BRIEF DESCRIPTION OF THE DRAWINGS

A better understanding of the present invention will be had upon reference to the following description in conjunction with the accompanying drawings.

DETAILED DESCRIPTION OF THE PREFERRED EMBODIMENTS

Figure 1:
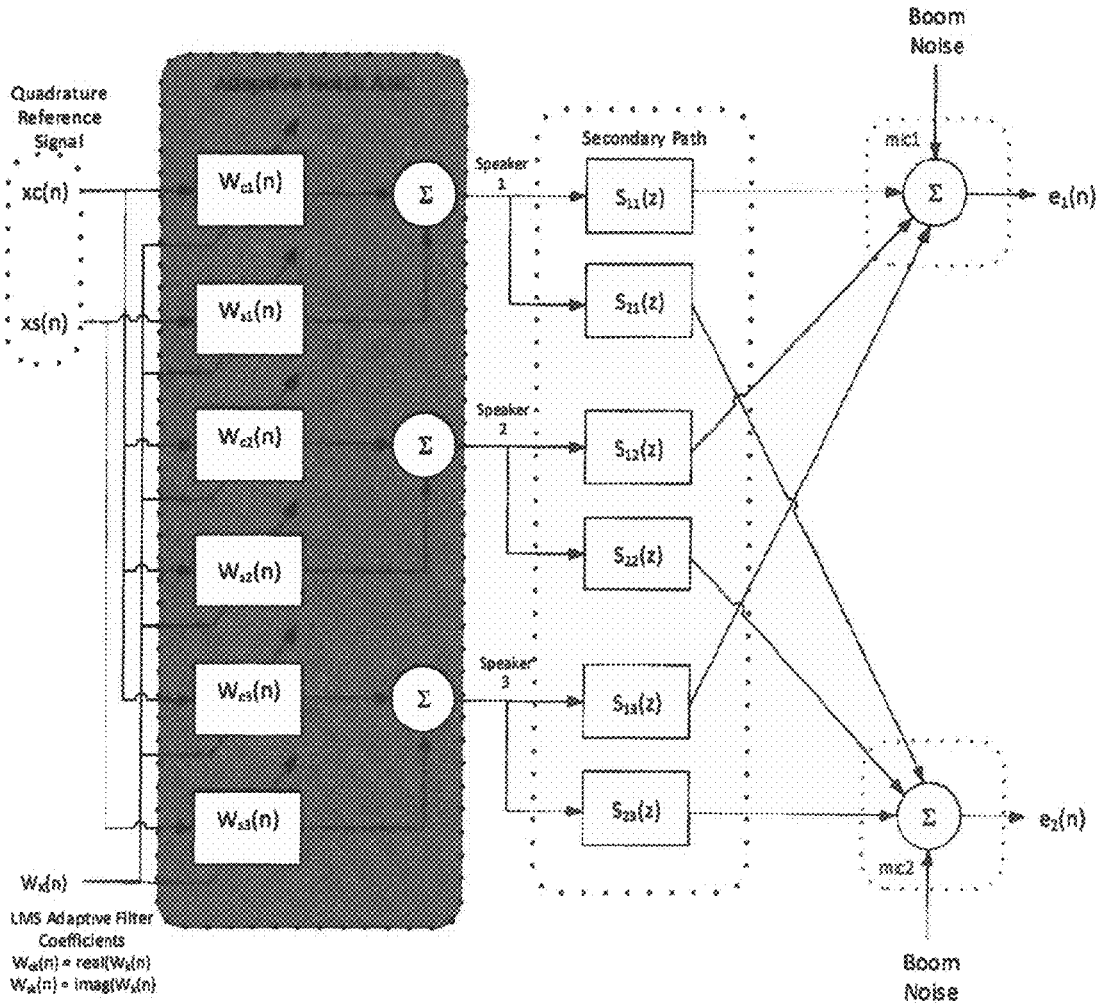
FIG. 1 is a block diagram of one embodiment of an adaptive notch filter ANC for a three speaker, two microphone system.

FIG. 1 illustrates one embodiment of a narrow band ANC. The ANC is narrow band in the sense that it may cancel only one frequency. The cancelation may occur at the microphones. K represents the number of speakers and M represents the number of microphones. Lowercase letter "m" refers to a microphone and lowercase letter "k" refers to a speaker. Given an engine speed, which may be expressed in terms of revolutions per minute (RPM), a boom frequency, $f_{rpm}$=f(n), is calculated. Then a reference signal is calculated:

$$x_c(n)=\cos(2\pi f(n)nT) \tag{0.1}$$

$$x_s(n)=\sin(2\pi f(n)nT) \tag{0.2}$$

Where T=sampling period.

$W_{ck}$ and $W_{sk}$ represent the adaptive filter coefficients of the $k_{th}$ speaker. $W_{ck}$ and $W_{sk}$ are adapted such that the outputs of the microphones, $e_m(n)$ are minimized in a least squares sense.

Narrow band ANC may use an LMS update algorithm called Filtered X (FXLMS). The room transfer function, $S_{mk}(z)$, can be compensated for by filtering the reference input X by an estimate of $S_{mk}(z)$. The realization of this estimate can be simplified by recognizing that at any instant in time the adaptive filter is concerned with only one frequency, f(n). Therefore, an FIR filter can be replaced with a simple complex multiplication:

$$C_{mk}(f(n))=S_{mk}(e^{(i2\pi f(n))}) \tag{0.3}$$

$$x'_{mk}(n)=x(n)C_{mk}(f(n)) \tag{0.4}$$

Figure 2:
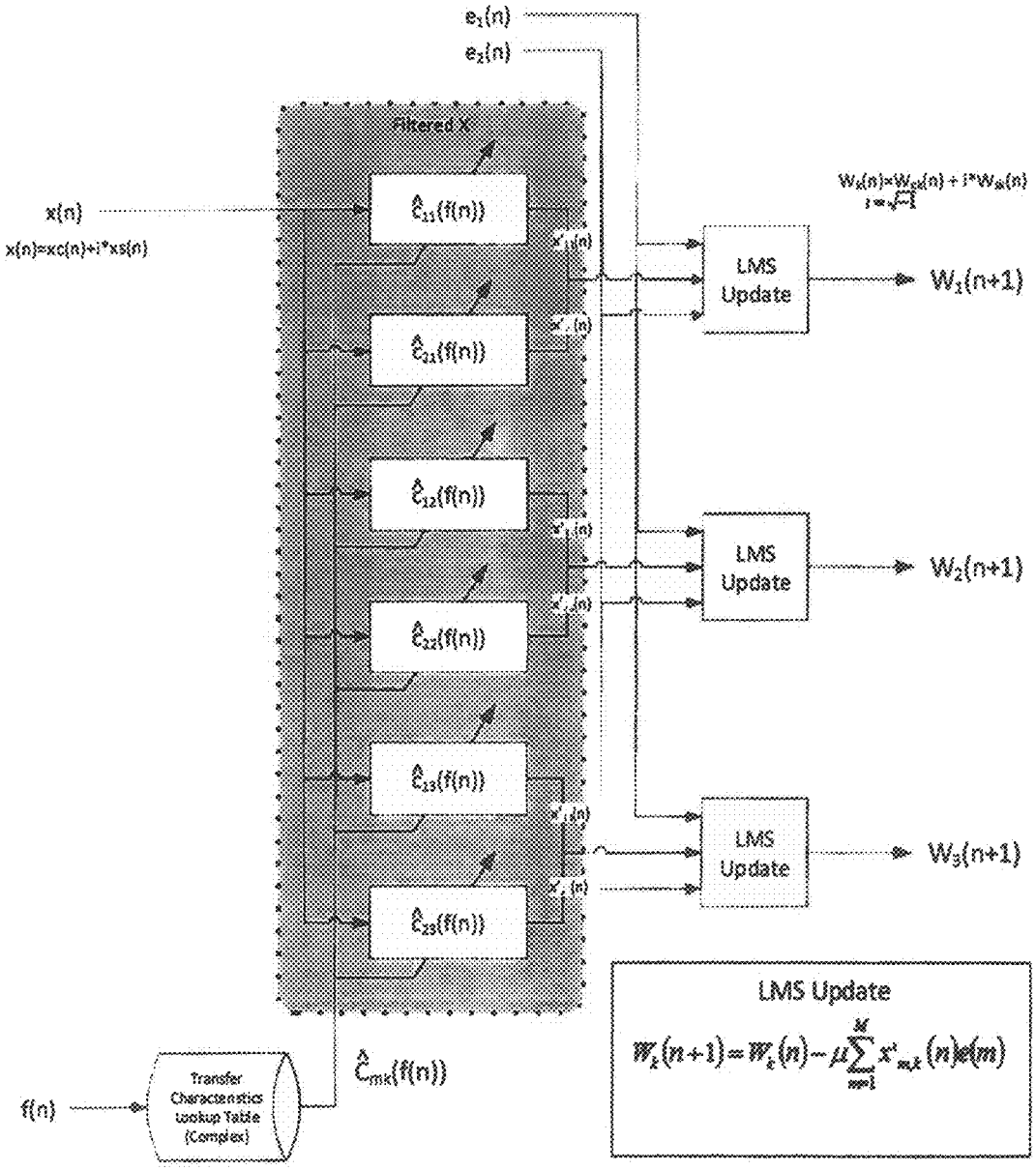
FIG. 2 is a block diagram of one embodiment of a least mean squares adaptive filter update.

$x'_{mk}(n)$ can then be used to update the filter weights of the FXLMS adaptive filter.

$$W_k(n=1)=W_k(n)-\mu\sum_{m=1}^{M}x'_{mk}(n)e(m) \tag{0.5}$$

Where e(m) is the output of microphone m. This process is shown in FIG. 2.

The stability of an FXLMS adaptive filter may be determined by the convergence factor μ. The bounds for stability are defined below. Referring to equations (0.1) and (0.2), the complex reference signal can be expressed as:

$$x(n)=x_c(n)+ix_s(n) \tag{0.6}$$

Each bin of the frequency response of $S_{mk}(z)$ can be written as, $$C_{mk}(\omega)=|fft(\hat{s}_{mk}(n))| \tag{0.7}$$

$$A_k(\omega)=\frac{1}{M}\left|\sum_{m=1}^{M}C_{mk}(\omega)\right| \tag{0.8}$$

Since x and $C_{mk}$ are complex sinusoids, the autocorrelation matrix R is 2×2 as shown in equation (0.9):

$$R_k(\omega)=\begin{bmatrix}\frac{A_k(\omega)^2}{2} & 0\\ 0 & \frac{A_k(\omega)^2}{2}\end{bmatrix} \tag{0.9}$$

The Eigen value of $R_k$ is $$\lambda_k(\omega)=\frac{A_k(\omega)^2}{2} \tag{0.10}$$

The range of stability of μ for each speaker and frequency is defined as:

$$0<\mu_k(\omega)<1/\lambda_k(\omega) \tag{0.11}$$

Stable and unique values may be calculated for μ. Assume that there is one speaker and one microphone. Let μMax(ω) represent the maximum stable value μ for all values of ω. Using the method stated above, λ(ω) and μMax(ω) are calculated as follows:

$$A(\omega)=|fft(\hat{s}_{11}(n))| \tag{0.12}$$

$$\lambda(\omega)=\frac{A(\omega)^2}{2} \tag{0.13}$$

$$\mu\mathrm{Max}(\omega)=\frac{1}{\lambda(\omega)} \tag{0.14}$$

$$\mu\mathrm{Max}(\omega)=\frac{L}{\lambda(\omega)} \tag{0.15}$$

The constant L may be used as a calibration factor. In real world applications, factors such as microphone gains, pre-amp settings, digital-to-analog converts, analog-to-digital converters, imperfect enclosures causing acoustical modes and nodes, and interactions with multiple speakers and microphones, call for L to be tuned for each system.

The constant L may be estimated. Let $\omega_{min}$ represent the frequency of a local minima of $\lambda(\omega)$. The largest stable value for $\mu Max(\omega_{min})$ may be found by experimentation, $f_{rpm}=2\pi\omega_{min}$. After $\mu Max(\omega_{min})$ has been determined, L may be calculated:

$$L=\lambda(\omega_{min})\mu Max(\omega_{min}) \tag{0.16}$$

Once L is known, equation (0.15) may be used to calculate all values of $\mu Max(\omega)$. Thus, by determining one value for $\mu$, all values can be calculated.

Figure 3:
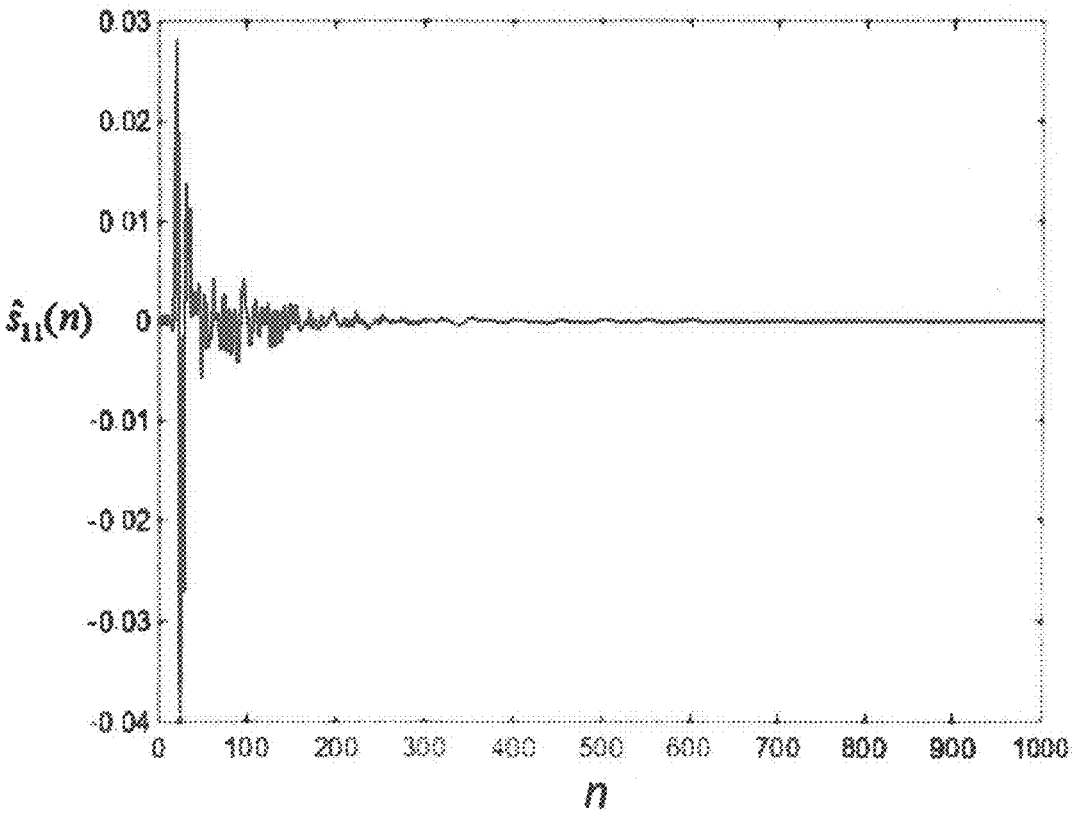
FIG. 3 is a plot of an example impulse response from a speaker to a microphone.
Figure 4:
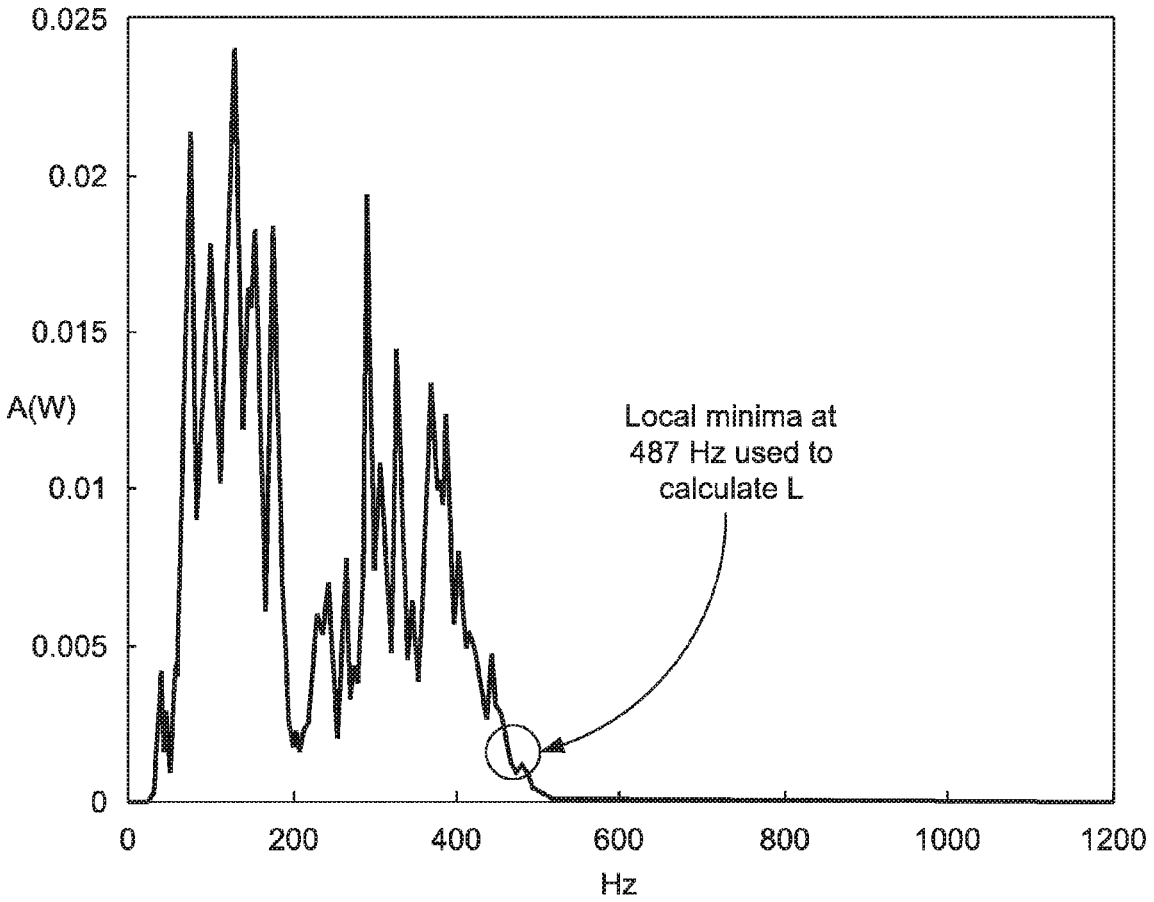
FIG. 4 is an example plot of λ(ω) versus frequency.
Figure 5:
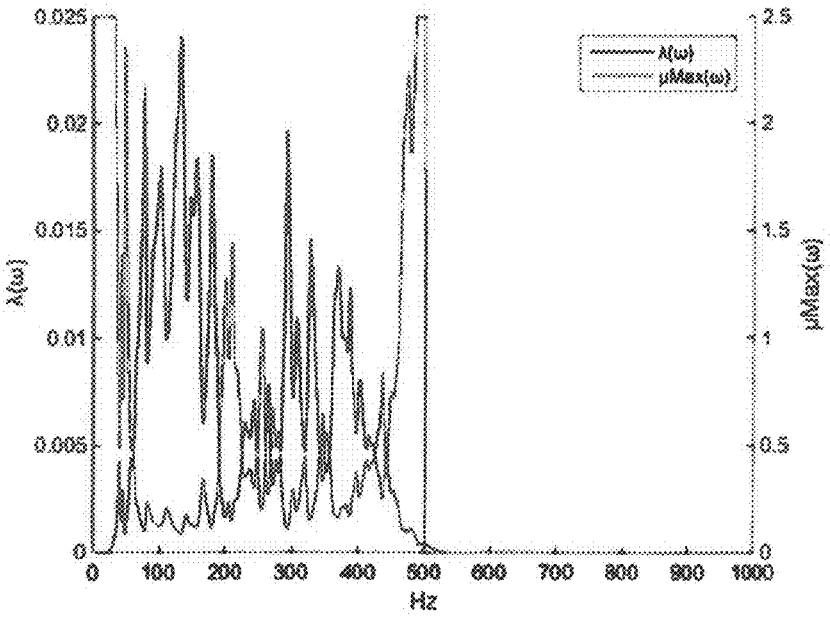
FIG. 5 is an example plot of λ(ω) and μMax(ω) versus frequency.

For the example case of M=1 and K=1, the impulse response (IR) from speaker to microphone is shown in FIG. 3. $\lambda(\omega)$ may be calculated according to (0.13). A local minimum of $\lambda(\omega)$ may be chosen as shown in FIG. 4. An experimental value of 2.5 for $\mu Max(\omega_{min})$ was measured. Using equation (0.16), L was calculated to be 0.0021. Applying equation (0.15), all values of $\mu Max(\omega)$ were calculated. FIG. 5 is an example plot of $\lambda(\omega)$ and $\mu Max(\omega_{min})$ as a function of frequency.

If there are multiple microphones and speakers, then the same techniques used for a 1×1 system can be used for an M×K system where M and K are >1:

$$\mu Max_k(\omega) = \frac{L_k}{\lambda_k(\omega)} \tag{0.17}$$

There may be a unique constant L for each speaker, $L_k$. The same calibration techniques described above may be used for each speaker. $\lambda_k(\omega)$ is defined in equation (0.10).

The inventive calibration technique may decrease the time and effort required to experimentally obtain stable values of $\mu$ for Narrow Band FXLMS Adaptive ANC systems. This technique still requires some experimentation to determine at least one value of $\mu$ for each speaker, but the overall required calibration time is greatly reduced.

Figure 6:
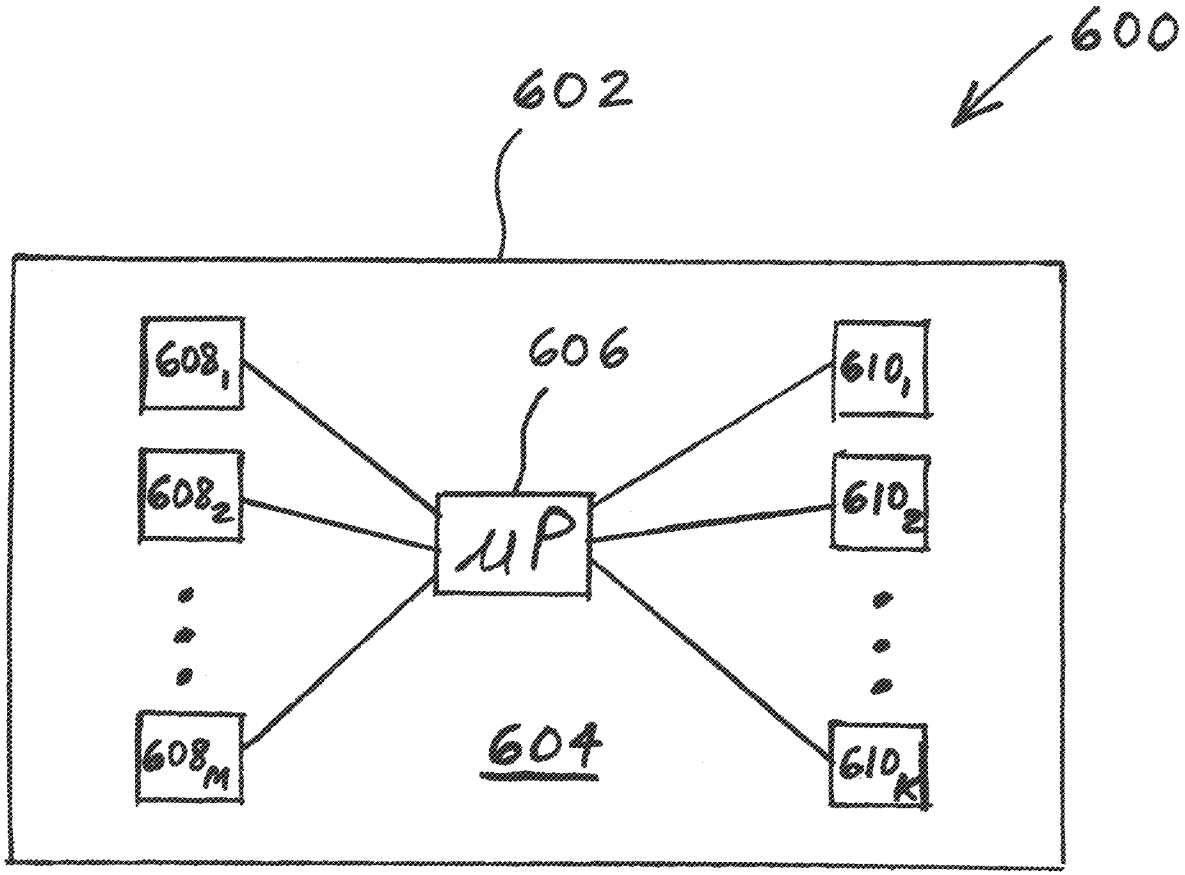
FIG. 6 is a block diagram of one embodiment of an automotive active noise control arrangement of the present invention.

FIG. 6 illustrates one embodiment of an automotive active noise control arrangement 600 of the present invention, including a motor vehicle 602 having a passenger compartment 604 containing an audio system with an electronic processor 606 communicatively coupled to M number of microphones 608 and K number of loudspeakers 610. Processor 606 may receive microphone signals from microphones 608 and may estimate a plurality of convergence factors for use in performing active noise control.

Figure 7:
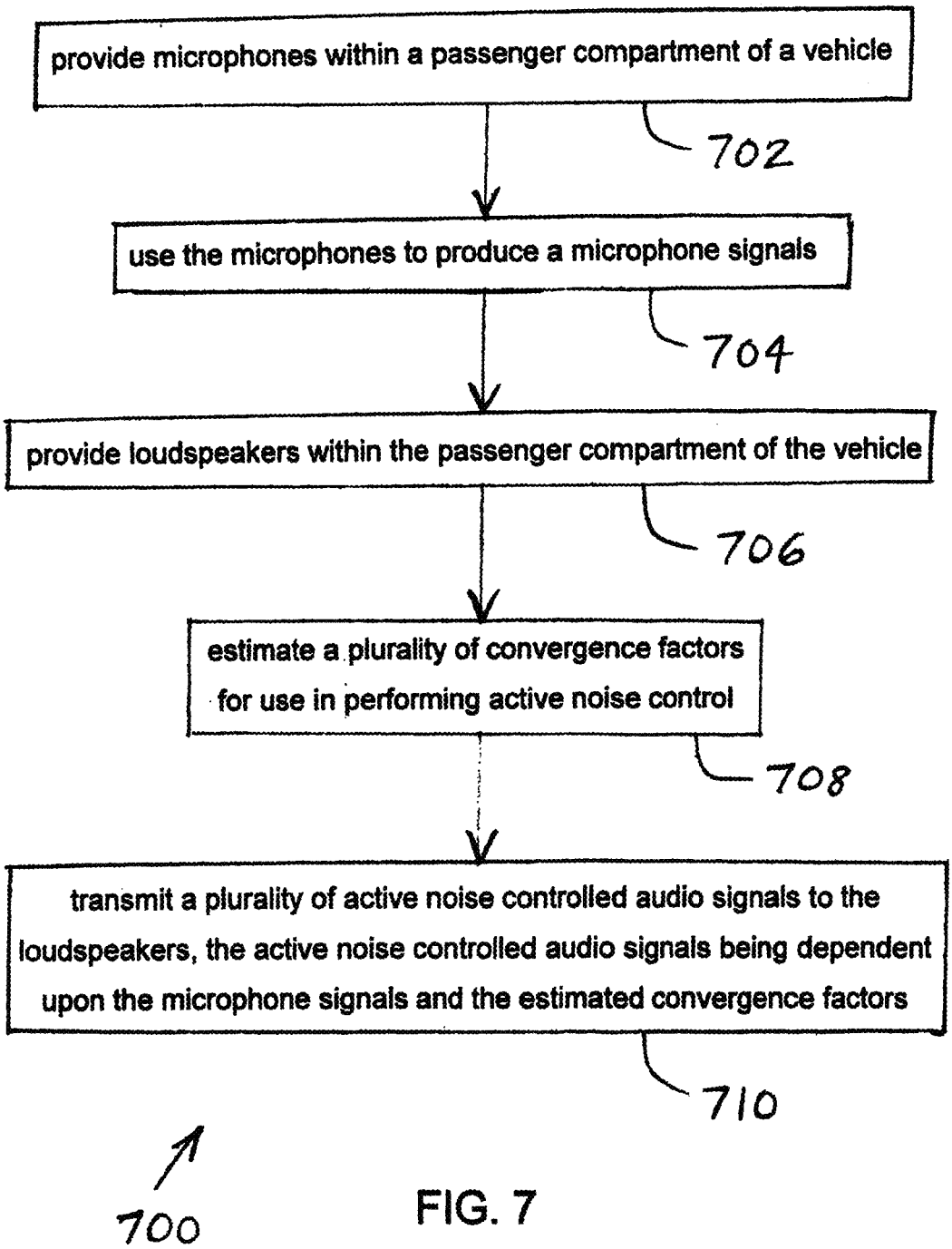
FIG. 7 is a flow chart of one embodiment of a method of the present invention for operating an audio system in a vehicle.

FIG. 7 is a flow chart of one embodiment of a method 700 of the present invention for operating an audio system in a vehicle. In a first step 702, microphones are provided within a passenger compartment of a vehicle. For example, microphones 608 may be installed within passenger compartment 604 of vehicle 602. In step 704, each of the microphones, such as microphones 608, may produce a respective microphone signal. Next, in step 706, loudspeakers are provided within a passenger compartment of the vehicle. For example, loudspeakers 610 may be installed within passenger compartment 604 of vehicle 602. In a next step 708, a plurality of convergence factors are estimated for use in performing active noise control. Such estimating of convergence factors may include calculating an Eigen value of an autocorrelation matrix of a passenger compartment transfer function; calculating a calibration factor dependent upon a largest stable value for one of the convergence factors at a minimum engine speed; and estimating all values of the one convergence factor within a range of engine speeds. The estimating of all values of the one convergence factor may be dependent upon the calibration factor and a plurality of Eigen values within the range of engine speeds. In a final step 710, a plurality of active noise controlled audio signals are transmitted to the loudspeakers, such as from processor 606 to loudspeakers 610. The active noise controlled audio signals may be dependent upon the microphone signals and the estimated convergence factors.

The foregoing description may refer to "motor vehicle", "automobile", "automotive", or similar expressions. It is to be understood that these terms are not intended to limit the invention to any particular type of transportation vehicle. Rather, the invention may be applied to any type of transportation vehicle whether traveling by air, water, or ground, such as airplanes, boats, etc.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A method of operating an audio system in a vehicle, the method comprising:

providing m number of microphones disposed within a passenger compartment of the vehicle, the microphones being configured to produce a plurality of microphone signals;

providing k number of loudspeakers disposed within a passenger compartment of the vehicle;

estimating a plurality of convergence factors $\mu$ for use in performing active noise control, the estimating including:

calculating an Eigen value $\lambda(\omega)$ of an autocorrelation matrix of a passenger compartment transfer function as $$\lambda_k(\omega) = \frac{A_k(\omega)^2}{2},$$

wherein $A_k(\omega)$ is the frequency response of the passenger compartment transfer function;

determining a frequency $\omega_{min}$ of a local minimum of $\lambda(\omega)$;

finding a largest stable value for $\mu Max(\omega_{min})$ by experimentation, wherein a rotational speed of an engine of the vehicle, expressed in revolutions per minute, $f_{rpm}=2\pi\omega_{min}$;

calculating a calibration factor as $L=\lambda(\omega_{min})\mu Max(\omega_{min})$;

estimating all values of $\mu Max(\omega)$ as $$\mu Max(\omega) = \frac{L}{\lambda(\omega)};$$

and transmitting a plurality of active noise controlled audio signals to the loudspeakers, the active noise controlled audio signals being dependent upon the microphone signals and the estimated convergence factors.

2. The method of claim 1 wherein m=1 and k=1.

3. The method of claim 1 wherein m>1 and k>1.

4. The method of claim 1 wherein the values of μMax(ω) are estimated over a range of frequencies with a resolution of about 1 Hz.

5. The method of claim 1 wherein the autocorrelation matrix R is:

$$R_k(\omega) = \begin{bmatrix} \frac{A_k(\omega)^2}{2} & 0 \\ 0 & \frac{A_k(\omega)^2}{2} \end{bmatrix}.$$

6. The method of claim 1 wherein a range of stability of μ for each speaker and frequency is $0<\mu_k(\omega)<1/\lambda_k(\omega)$.

7. The method of claim 1 wherein the active noise controlled audio signals are produced by a narrow band filtered X LMS adaptive active noise control system.

8. A method of operating an audio system in a vehicle, the method comprising:

providing a plurality of microphones associated with a passenger compartment of the vehicle, the microphones being configured to produce a plurality of microphone signals;

providing a plurality of loudspeakers associated with the passenger compartment of the vehicle;

estimating a plurality of convergence factors for use in performing active noise control, the estimating including:

calculating an Eigen value of an autocorrelation matrix of a passenger compartment transfer function, the Eigen value being a function of a rotational speed of an engine of the vehicle;

determining an engine rotational speed associated with a local minimum of the Eigen value;

finding by experimentation a largest stable value for one of the convergence factors at a minimum engine speed;

calculating a calibration factor dependent upon the largest stable value for one of the convergence factors at a minimum engine speed; and estimating all values of the convergence factor within a range of engine speeds, the estimating being dependent upon the calibration factor and the Eigen values within the range of engine speeds; and transmitting a plurality of active noise controlled audio signals to the loudspeaker, the active noise controlled audio signals being dependent upon the microphone signals and the estimated convergence factor values.

9. The method of claim 8 wherein the Eigen value is $$\lambda_k(\omega) = \frac{A_k(\omega)^2}{2},$$

wherein $A_k(\omega)$ is a frequency response of the passenger compartment transfer function.

10. The method of claim 9 wherein the calibration factor is calculated as $L=\lambda(\omega_{min})\mu\mathrm{Max}(\omega_{min})$, wherein μ is the convergence factor.

11. The method of claim 9 wherein the estimating all values of the convergence factor includes estimating all values of μMax(ω) as $$\mu\mathrm{Max}(\omega) = \frac{L}{\lambda(\omega)}.$$

12. The method of claim 11 wherein the values of μMax(ω) are estimated over a range of frequencies with a resolution of less than 10 Hz.

13. The method of claim 8 wherein the autocorrelation matrix is:

$$R_k(\omega) = \begin{bmatrix} \frac{A_k(\omega)^2}{2} & 0 \\ 0 & \frac{A_k(\omega)^2}{2} \end{bmatrix}$$

wherein $A_k(\omega)$ is a frequency response of the passenger compartment transfer function.

14. The method of claim 8 wherein a range of stability of the convergence factor μ for each speaker and frequency is $0<\mu_k(\omega)<1/\lambda_k(\omega)$, wherein $\lambda_k(\omega)$ is the Eigen value.

15. A method of operating an audio system in a vehicle, the method comprising:

providing at least one microphone associated with a passenger compartment of the vehicle, the microphone being configured to produce a plurality of microphone signals;

providing at least one loudspeaker associated with the passenger compartment of the vehicle;

estimating a plurality of convergence factors for use in performing active noise control, the estimating including:

calculating an Eigen value of an autocorrelation matrix of a passenger compartment transfer function;

calculating a calibration factor dependent upon a largest stable value for one of the convergence factors at a minimum engine speed; and estimating all values of the one convergence factor within a range of engine speeds, the estimating being dependent upon the calibration factor and a plurality of Eigen values within the range of engine speeds; and transmitting a plurality of active noise controlled audio signals to the loudspeaker, the active noise controlled audio signals being dependent upon the microphone signals and the estimated convergence factor values.

16. The method of claim 15 wherein the Eigen value is a function of a rotational speed of an engine of the vehicle.

17. The method of claim 15 further comprising determining an engine rotational speed associated with a local minimum of the Eigen value.

18. The method of claim 17 further comprising finding by experimentation the largest stable value for one of the convergence factors at a minimum engine speed.

19. The method of claim 15 wherein the Eigen value is $$\lambda_k(\omega) = \frac{A_k(\omega)^2}{2},$$

wherein $A_k(\omega)$ is a frequency response of the passenger compartment transfer function.

20. The method of claim 19 wherein the calibration factor is calculated as $L=\lambda(\omega_{min})\mu\mathrm{Max}(\omega_{min})$, wherein μ is the convergence factor, wherein the estimating all values of the one convergence factor includes estimating all values of μMax(ω) as $$\mu\mathrm{Max}(\omega) = \frac{L}{\lambda(\omega)},$$

wherein the values of μMax(ω) are estimated over a range of frequencies with a resolution of less than 100 Hz.

* * * * *